US005316310A

United States Patent [19]

Nicholas, Sr. et al.

[11] Patent Number: 5,316,310

[45] Date of Patent: May 31, 1994

[54] DISC TOSS GAME

[76] Inventors: Oscar E. Nicholas, Sr., 1110 Spruce St., Leesville, La. 71446; Martin Rogers, Rogers Loop, New Llano, La. 71461; Anthony J. Caruso, 908 Marvin Ave., Leesville, La. 71446; Perry F. Morrow, P.O. Box 1124, Leesville, La. 71496

[21] Appl. No.: 66,557

[22] Filed: May 27, 1993

[51] Int. Cl.[5] ..... A63B 67/06; A63B 65/10

[52] U.S. Cl. ..... 273/317; 273/400; 273/424; 273/DIG. 20

[58] Field of Search ..... 273/317, 348, 353, 424, 273/425, 427, DIG. 20, 336, 337, 338, 339, 398, 400

[56] References Cited

U.S. PATENT DOCUMENTS

| | | | |
|---|---|---|---|
| 285,396 | 9/1883 | Windt | 273/415 |
| 715,249 | 12/1902 | Dunbar | 273/415 |
| 757,440 | 4/1904 | Croxford | 273/401 |
| 810,234 | 1/1906 | Sackett | 273/401 |
| 922,717 | 5/1909 | Parker | 273/415 |
| 1,279,654 | 9/1918 | Charlesworth | 273/401 |
| 1,513,968 | 5/1924 | Crandall | 273/336 |
| 2,287,113 | 6/1942 | Markey | 273/401 |
| 2,634,982 | 4/1953 | Gaede | 273/424 |
| 3,001,791 | 9/1961 | Atwood | 273/401 |
| 3,163,421 | 12/1964 | Matyko | 273/415 |
| 3,201,128 | 8/1965 | Palovik | 273/424 |
| 4,989,880 | 2/1991 | Gettemeier et al. | 273/336 |

*Primary Examiner*—William H. Grieb
*Attorney, Agent, or Firm*—John M. Harrison

[57] ABSTRACT

A disc toss game which includes a game mat having a smooth surface and a textured surface, both surfaces having surface indicia for designating target areas for a disc which is tossed onto the game mat. In a preferred embodiment the disc is characterized by a resilient, smooth material tapered along a segment of the disc perimeter and having a fixed weight at this tapered segment, along with internal cavities for receiving a freely-shifting particulate material for shifting the weight distribution and altering the flight characteristics of the disc as the disc is tossed.

12 Claims, 1 Drawing Sheet

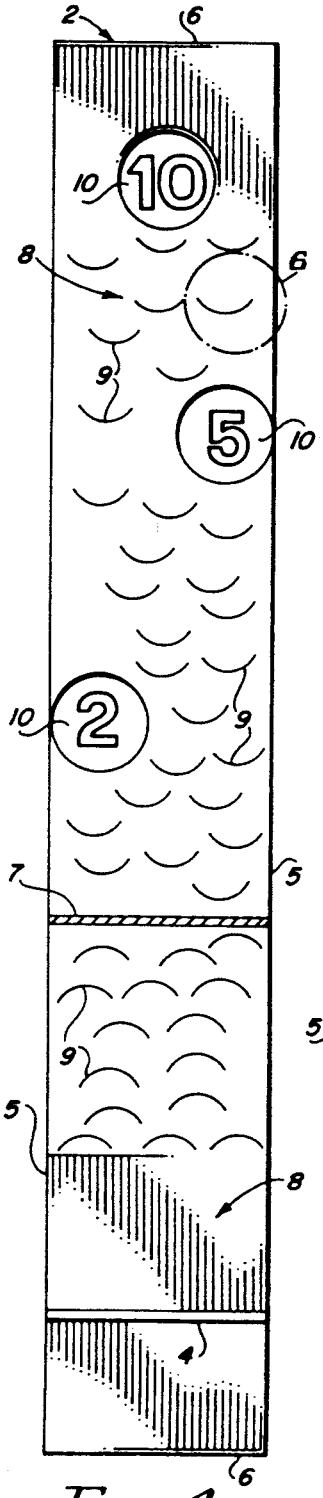
FIG. 1
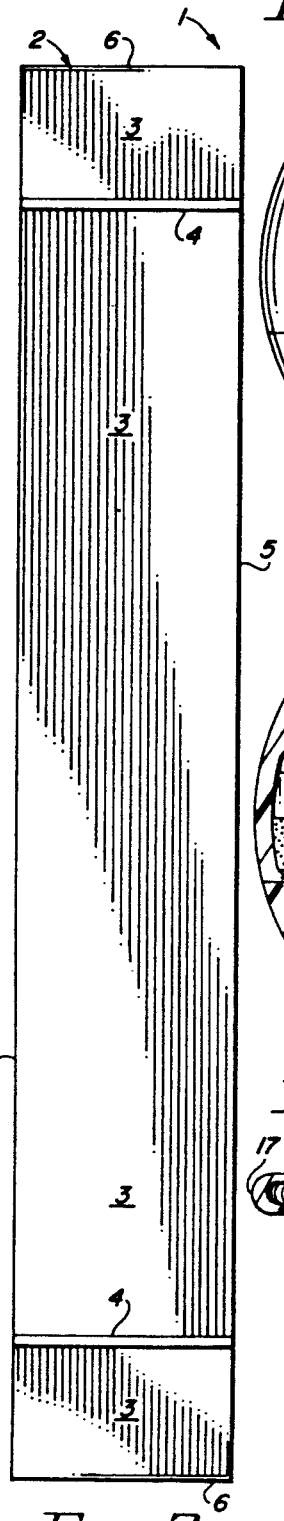
FIG. 2
FIG. 3
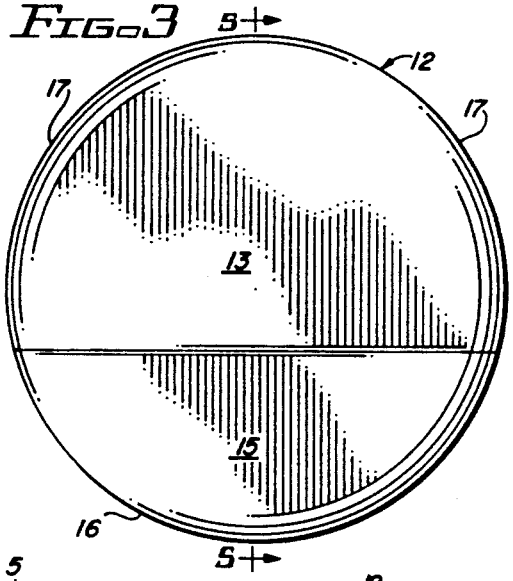
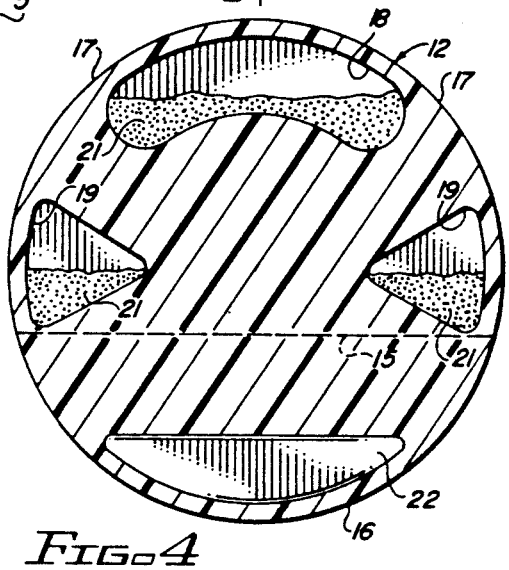
FIG. 4
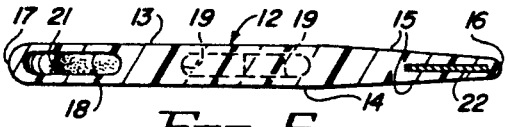
FIG. 5
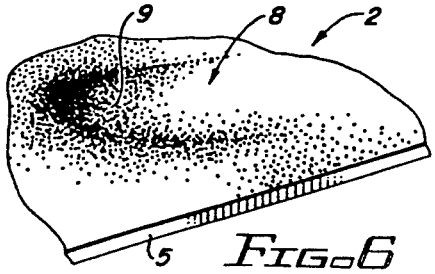
FIG. 6

DISC TOSS GAME

BACKGROUND OF THE INVENTION

1. Field of the Invention

This invention relates to tossing games and more particularly, to a disc toss game which is characterized by an elongated, flat game mat having a smooth surface and a textured surface, both provided with surface indicia for marking the location of a disc which is tossed onto the game mat by a player. In a preferred embodiment the smooth surface of the game mat includes one or more target lines, located commensurate with the skill of the player tossing the disc, while the textured surface includes a foul line and multiple, arcuate and circular depressions which tend to cause the disc to skitter and deflect after striking the game mat. In a most preferred embodiment of the invention the disc is configured with a taper and a corresponding fixed weight along a segment of the disc periphery, with particulate material located in various cavities in the disc. The disc toss game is easily stored and carried in a flexible, zippered carrier.

2. Description of the Prior Art

Many toss-type games are known in the art. Among the most popular of these games is the old and popular game of "horseshoes", which involves tossing enlarged horseshoes toward spaced apart metal stakes, with a view toward engaging the horseshoes with the stakes. U.S. Pat. No. 285,396, dated Sep. 25, 1883, to K. Adams, details a game board mounted on a frame, to which frame is suspended a bell that may be struck by a bag passing over the primary area of the game board. A central opening is provided in the game board and the contestants stand at a distance from the game board and attempt to toss the bags in the central opening, which counts the highest number of points. Various other scoring may be achieved by striking the game board at certain points. U.S. Pat. No. 715,249, dated Dec. 9, 1902, to E. H. Dunbar, details a "Game Apparatus" which includes a triangular-shaped board mounted on a frame and fitted with multiple holes, underneath which are secured elongated pockets. A projectile such as a leather bag containing small, loose particles is then thrown toward the board, with a view toward tossing the particle-filled leather projectile through one of the openings in the board. U.S. Pat. No. 757,440, dated Apr. 19, 1904, to J. S. Croxford, details a funnel-shaped frame which opens upwardly and is fitted with canvas panels having multiple pockets shaped therein. The object of the game is to toss a ball into one of the pockets. Another "Game Apparatus" is detailed in U.S. Pat. No. 810,234, dated Jan. 16, 1906, to F. L. Sackett. The device includes an octagonal-shaped game table provided with multiple openings or pockets and upward-standing rubber pins. An oblate spheroid game piece is projected toward the pockets in the game table by a modified pool cue. U.S. Pat. No. 922,717, dated May 25, 1909, to G. H. Parker, details a game which includes a game board pivotally mounted in a case or box and supported by a wire member when the box is in the open configuration. The wire member supports the game board at an angle with respect to the horizontal and the game board is fitted with multiple openings for receiving a projectile tossed by contestants standing at a distance from the game board. U.S. Pat. No. 1,279,654, dated Sep. 24, 1918, to H. M. Charlesworth, details a "Game Apparatus". The game apparatus includes a game board tilted on foldable legs, with multiple, netted openings therein and a spring-operated catapult located at a selected distance from the game board for catapulting a ball toward the game board, with a view toward placing the ball in one of the netted openings. U.S. Pat. No. 2,287,113, dated Jun. 23, 1942, to A. J. Markey, details an "Amusement Device" which includes an elevated game board fitted with multiple openings or cups and a sliding tray attached to the game board for recording scores. Each player stands a selected distance from the game board and tries to direct a ball, coin, or other playing member toward the target, which is one of the cups in the game board. U.S. Pat. No. 3,001,791, dated Sep. 26, 1961, to G. K. Atwood, details a "Table Game" which is foldable and includes a net extended across the center, as in a ping pong table. A pair of recessed, netted openings are provided in the table on each side of the net and the object of the game is to direct a ping-pong ball over the net and into the netted opening.

It is an object of this invention to provide a new and improved disc toss game which includes a game mat having a smooth surface and a textured surface, both provided with target indicia, and a disc which is tossed onto the game mat toward the target indicia.

Another object of the invention is to provide a new and improved disc toss game which includes an elongated, flat game mat having a smooth surface and a textured surface and provided with target indicia and a smooth disc having a taper provided with a fixed weight and at least one internal cavity for receiving particulate material to influence the disc in flight when the disc is tossed toward the target indicia on the game mat.

Yet another object of this invention is to provide a new and improved disc toss game which includes at least one target indicia on a flat or textured surface and a tapered, weighted disc for tossing at the target indicia.

A still further object of this invention is to provide a disc toss game which is characterized by an elongated, resilient flexible game mat having a "memory", a smooth side and a textured side and at least one target indicia provided on each side of the mat, and a disc having a tapered, weighted peripheral edge segment and multiple internal cavities partially filled with particulate material, for tossing at the target indicia on the game mat.

SUMMARY OF THE INVENTION

These and other objects of the invention are provided in a new and improved disc toss game which is characterized by an elongated, flexible plastic, rubber or composite mat of selected length, width and thickness and having a "memory", a smooth surface and a textured surface, with at least one target indicia provided on both mat surfaces and a disc adapted for tossing at the target indicia on the mat, which disc is characterized by a tapered, weighted edge segment and three hollow cavities partially filled with a freely shifting particulate material to enhance the skill necessary to toss the disc into close proximity to the target indicia.

BRIEF DESCRIPTION OF THE DRAWING

The invention will be better understood by reference to the accompanying drawing, wherein:

FIG. 1 is a top view of a game mat element of this invention with a textured surface facing upwardly;

FIG. 2 is a top view of the game mat illustrated in FIG. 1 with a smooth surface facing upwardly;

FIG. 3 is a top or bottom view of a disc element of the disc toss game;

FIG. 4 is a longitudinal sectional view of the disc illustrated in FIG. 3;

FIG. 5 is a sectional view taken along line 5—5 of the disc illustrated in FIG. 3; and FIG. 6 is an enlarged view of an edge segment of the game mat illustrated in FIG. 1.

DESCRIPTION OF THE PREFERRED EMBODIMENTS

Referring initially to FIGS. 1-3 and 6 of the drawing, the disc toss game of this invention is generally illustrated by reference numeral 1. As illustrated in FIGS. 1 and 2, a first element of the disc toss game 1 is characterized by an elongated, rectangular game mat 2 having a smooth surface 3, provided with spaced-apart target lines 4 and defined by mat sides 5 and mat ends 6 of selected dimension. A textured surface 8 is provided on the opposite side of the game mat 2 from the smooth surface 3. The textured surface 8 of the game mat 2 is characterized by a foul line 7, multiple arcuate depressions 9, more particularly illustrated in FIG. 6, provided either in a pattern or in a selected randomly stamped configuration and circular depressions 10 of selected diameter. As illustrated in FIGS. 3—5, the second element of the disc toss game 1 is a disc 12, which is characterized by a smooth top disc surface 13 and bottom disc surface 14 and is constructed or molded of a resilient material such as a suitable rubber or plastic composition or like material, in non exclusive particular. In a preferred embodiment of the invention the disc 12 is characterized by a smooth surface taper 15 extending from the top disc surface 13 and bottom disc surface 14, to an arc of selected length along the perimeter of the disc 12, to define a tapered edge 16, as illustrated in FIG. 5. A fixed weight 22, such as a sheet of lead or other metal, is encapsulated or otherwise mounted in or on the disc 12 at the tapered edge 16, as further illustrated in FIGS. 4 and 5. The remaining peripheral or perimeter dimension of the disc 12 extending from the surface and taper 15 is characterized by a rounded, non-tapered edge 17 and a non-tapered edge cavity 18 is located inside the disc 12 adjacent to the non-tapered edge 17, as illustrated in FIGS. 4 and 5. A pair of intermediate cavities 19 are provided in the disc 12 adjacent to the non-tapered edge cavity 18 and spaced approximately along a diameter of the disc 12, as further illustrated in FIGS. 4 and 5. In a most preferred embodiment of the invention a particulate, flowable material 21 such as sand, metal shot or the like, is located in the non-tapered edge cavity 18 and the intermediate cavities 19 to effect a shift in the weight of the disc 12 as the disc 12 is tossed toward the game mat 2, as hereinafter further described.

In a preferred embodiment of the invention a conventional flexible carrying case fitted with a handle and a zipper may be used for carrying the game mat 2 and the disc 12. The carrying case is typically constructed of a flexible material such as rip-stop nylon, canvas or the like and is designed to receive both the game mat 2, in rolled or folded configuration, and the disc 12.

It will be appreciated from a consideration of the design of the disc 12, as well as the game mat 2, that the disc toss game 1 may be played by substantially any number of players and great skill is required for tossing the disc 12 onto either the smooth surface 3 or the textured surface 8 of the game mat 2 in close proximity to a designated target line 4. It will be further appreciated that the disc 12 is tossed from a preselected position spaced from the game mat 2 onto the smooth surface 3 or the textured surface 8, with a view toward approaching, but not encroaching upon, a selected target line 4. The player therefor attempts to spin or flat-toss the disc 12 onto the game mat 2 in order to effect a shift of the particulate material 21 in the non-tapered edge cavity 18 and the intermediate cavities 19. This weight shift causes the non-tapered edge 17 or the tapered edge 16 of the disc 12 to engage one or more of the arcuate depressions 9 or the circular depressions 10 in the textured surface 8 and deflect toward the target line 4. Alternatively, the disc 12 may be caused to slide on the smooth surface 3 of the game mat 2 into close proximity to one of the target lines 4. It will be further appreciated that approaching, but not encroaching upon the target lines 4 is rendered more difficult when the disc 12 is tossed on the game mat 2 with the textured surface 8 facing upwardly, since the arcuate depressions 9 and circular depressions 10 tend to impede the sliding progress of the disc 12 across the textured surface 8. Accordingly, great skill is required in manipulating the disc 12 in a spinning or flat-toss configuration to skitter or bounce the disc 12 across the textured surface 8, into close proximity to one of the target lines 4 or into one of the circular depressions 10, which may serve as alternate target objectives in the disc toss game 1.

It will be further appreciated by those skilled in the art that the game mat 2 element of the disc toss game 1 may be constructed of various materials, of which low or high density plastic, rubber or plastic-coated rubber are preferred materials. Accordingly, the textured surface 8, including the arcuate depressions 9 and circular depressions 10, can be formed in one side of the game mat 2, while a smooth surface 3 may be shaped in the opposite side of the game mat 2. In a most preferred embodiment the game mat 2 is constructed, extruded or molded of a flexible, resilient material having a "memory" to facilitate rolling or folding in a carrying case and periodically extending into functional playing configuration. It will be further appreciated that the difficulty of placing the disc 12 into close proximity to either of several target lines 4, or in the circular depressions 10 in the textured surface 8 of the game mat 2, varies broadly with positioning of the game mat 2 to expose either the smooth surface 3 or the textured surface 8 to the player. For example, it is much more difficult to accurately toss, spin or lag the disc 12 into close proximity to a target line 4 or a circular depression 10 from the foul line 7 when the textured surface 8 is facing upwardly, than when the smooth surface 3 of the disc toss game 1 is positioned upwardly, as heretofore described. Furthermore, the disc toss game 1 can be rendered more or less difficult by adjusting the distance between the point where the player or contestant must stand to toss the disc 12 and the game mat 2, as deemed appropriate, considering the age of the players. Moreover, it will be appreciated by those skilled in the art that the disc toss game 1 can be played both indoors and outdoors, depending upon weather conditions, by any number of players and that great skill may be acquired by practice in tossing the disc 12 to compensate for, and use to advantage, the movement and shifting of the particulate material 21 inside the non-tapered edge cavity 18 and intermediate cavities 19. Furthermore, while a single non-tapered edge cavity 18 and a pair of intermediate cavities 19 are disclosed in the drawing of the disc 12, it will be appreciated that substantially any number of cavities may be provided therein in selected spacial orientation inside the disc 12. The purpose of these cavities and the particulate material therein is to effect shifting of the particular material inside the cavity or cavities to affect the disc spin and balance. This renders accurate placement of the disc 12 on either the smooth surface 3 or the textured surface 8 of the game mat 2, in close proximity to the target lines 4, more difficult and thereby raises the level of skill necessary to play the disc toss game.

It is understood that in lieu of the game mat 2, various target indicia such as the target lines 4 can be painted, taped or otherwise placed on a flat or textured surface such as concrete, or even grass, dirt or sand and the disc 12 tossed at the target indicia as described above.

While the preferred embodiments of the invention have been described above, it will be recognized by those skilled in the art that various other modifications may be made in the invention without departing from the spirit and scope thereof.

Having described my invention with the particularity set forth above, what is claimed is:

1. A disc toss game apparatus comprising target means and a disc having a disc perimeter, a tapered edge segment extending along a portion of said disc perimeter, a plurality of separate cavities provided in said disc and a separate mass of particulate material provided in each of said separate cavities for shifting the center of gravity of said disc when said disc is tossed at said target means.

2. The disc toss game apparatus of claim 1 comprising a game mat and wherein said target means is located on said game mat.

3. The disc toss game apparatus of claim 2 wherein said game mat is constructed of a substantially flexible, resilient material.

4. The disc toss game apparatus of claim 2 comprising a first substantially smooth target surface provided on one side of said game mat and a textured target surface provided on the opposite side of said game mat and said target means comprises first target indicia provided on said first substantially smooth target surface and second target indicia provided on said textured target surface of said mat.

5. The disc toss game apparatus of claim 4 comprising a fixed weight provided in said disc at said tapered edge segment.

6. The disc toss game apparatus of claim 1 comprising a fixed weight provided in said disc at said tapered edge segment.

7. The disc toss game apparatus of claim 1 comprising a game mat and wherein said target means is located on said game mat and further comprising a fixed weight provided in said disc at said tapered edge segment.

8. A disc toss game apparatus comprising an elongated, flexible game mat having a "memory", a substantially smooth playing surface, a textured playing surface opposite said smooth playing surface and target indicia provided on said smooth playing surface and said textured playing surface; and a disc, a plurality of individual cavities provided in said disc and a separate mass of particulate material of selected weight provided in each of said individual cavities for shifting the center of gravity of said disc whereby said disc is selectively tossed onto said smooth playing surface and said textured playing surface at said target indicia.

9. The disc toss game apparatus of claim 8 wherein said disc means comprises a disc having a disc perimeter of selected diameter and a tapered edge segment extending along a portion of said disc perimeter.

10. The disc toss game apparatus of claim 9 comprising a fixed weight provided in said disc at said tapered edge segment.

11. The disc toss game apparatus of claim 10 comprising at least one cavity provided in said disc and at least one mass of particulate material having a selected weight provided in said cavity for shifting the center of gravity of said disc responsive to shifting of said particulate material in said cavity when said disc is tossed at said target indicia.

12. The disc toss game of claim 8 wherein said target indicia comprises at least one first target line provided on said smooth target surface and at least one second target line, a plurality of arcuate depressions and at least one circular depression provided in said textured target surface.

* * * * *